United States Patent [19]

Bercaw

[11] Patent Number: 4,924,601

[45] Date of Patent: May 15, 1990

[54] SYSTEM FOR CONDITIONING GRAIN

[76] Inventor: Willis M. Bercaw, Box 65, West York, Ill. 62478

[21] Appl. No.: 385,500

[22] Filed: Jul. 27, 1989

[51] Int. Cl.[5] ..... F26B 21/06

[52] U.S. Cl. ..... 34/46; 34/92; 34/51; 34/16.5; 34/67

[58] Field of Search ..... 34/46, 92, 51, 15, 16.5, 34/65, 67

[56] References Cited

U.S. PATENT DOCUMENTS 4,257,173 3/1981 Smith ..... 34/92

4,688,332 8/1987 Kallestad et al. ..... 34/46 X

*Primary Examiner*—Henry A. Bennet

*Assistant Examiner*—John Sollecito

[57] ABSTRACT

A system for conditioning grain in a sealed container through the removal of liquid from a bushel of grain by sequentially evacuating high relative humidity air from the sealed container and thereafter allowing dry environmental air to reenter the sealed container. A sensor in the sealed container detects the relative humidity therein and supplies a controller with a signal to operate a pump which evacuates high relative humidity air from the sealed container. Thereafter, a pressure sensor detects a vacuum in the sealed container and supplies the controller with a signal which terminates the operation of the pump to allow dry environmental air to reenter the sealed container. The replacement of high relative humidity air with dry environmental air continues until the liquid content per bushel of grain is at a desired level.

7 Claims, 1 Drawing Sheet

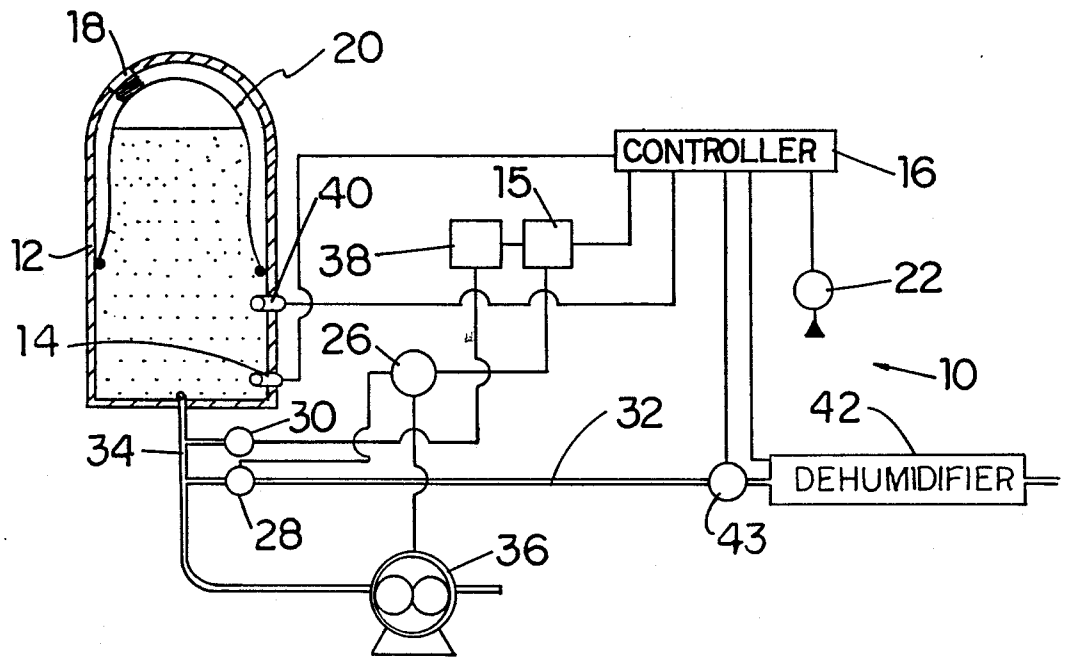
CONTROLLER
DEHUMIDIFIER
10
12
14
15
16
18
20
22
26
28
30
32
34
36
38
40
42
43

SYSTEM FOR CONDITIONING GRAIN

This invention relates to a system for conditioning grain through the removal of liquid from a sealed container by sequentially evacuating high relative humidity air from the sealed container and thereafter replacing the same with dry environmental air.

For all grains there is an optimum harvest efficiency where grain loss is at a minimum. Unfortunately, the time period for this optimum harvest is limited to dry weather conditions and grain maturity. Grain can be harvested at any time when the moisture content is below 25% but in order to store such grain for an extended period of time, it must be dried to about 15% moisture. For instance, after corn reaches a dent condition, and progresses toward the harvest Condition, before it can be stored without spoilage the moisture content must be below 17%.

A bushel of corn has a set volume and weighs 56 pounds. At 15% moisture, the solid matter in a bushel of corn has been established at 47.32 pounds and the liquid content is 8.68 pounds. Liquid content in a bushel may change but the solid content always remains constant. Thus, it is important to remember that as grain is dried, the resulting weight occurs from the evaporation of water from within each kernal of grain.

The cheapest way to dry grain is through an equilibrium system wherein environmental air is continually passed through stored grain. However, in such a system if the air is too dry, the grain overdries whereas if the relative humidity of the air is too high, the grain never dries properly.

A more effective manner of drying grain is to use a non-equilibrium system, wherein hot, dry air is continually forced through the stored grain.

In both of these systems there exists a drying front in the storage bin. A drying front is a zone where grain has reached a point of equilibrium below the front with wet grain above the front. Unfortunately, in the non-equilibrium system, if equllibrium occurs, the grain overdries resulting in excessive shrink and cracking. To avoid such over-drying, the grain must be moved by either a conveyor to another bin, or continually mixed by a stirrer until a desired moisture content is achieved. Unfortunately, the stirring action can create a column in the grain from the top to the bottom of the storage bin which causes an air leak. An air leak is a volume of air that moves in the center area and is under a lower static pressure than the static pressure near the walls of the storage bin. Within such columns, air is exhausted without being saturated with water. Under such conditions, the cost of drying is unnecessarily increased. To avoid air columns, an upper limit for air flow exists such that the velocity of the air entering a bin should not exceed about 1750 ft./minute If the velocity is greater than this, a uniform drying front is not achieved and uneven air drying columns are produced. In addition, when grain is not dried at a uniform rate it is possible to cause moisture build up on the top of the storage bin which can produce mold in the grain. Tests have shown that an air flow of 1 cfm/bu can dry about ¾ft. of grain per day.

In the present invention it has been discovered that grain in a storage bin can be dried to a desired moisture content through an air equilibrium system by sequentially evacuating air from a sealed bin and replacing the same with dry environmental air. Dry environmental air is presented to the sealed bin and after a period of, the moisture in the grain evaporates to thereafter raise the relative humidity of the air in the sealed container. A first sensor in the sealed bin provides a controller with an initial signal indicative of the moisture content in the grain while a second sensor detects the relative humidity of the environmental air and provides the controller with a second signal. As long as the signal from the first sensor indicates a moisture content in the grain which is above a desired moisture content, and the relative humidity is below a set level as indicated by the second signal, the controller responds by supplying a solenoid valve with an operational signal. Operation of the solenoid terminates communication of dry environmental air to the sealed bin and a pump is supplied with an operational signal. Thereafter, the pump evacuates the high relative humidity air from the sealed bin. When the fluid pressure in the sealed chamber reaches a vacuum level of between 20–22 in. Hg in the sealed bin, a sensor supplies the controller with a termination signal to switch off the pump and open the solenoid valve to again allow dry environmental air to reenter the sealed bin. Should the relative humidity of the environmental air be above about 80%, the operational signal to the the solenoid valve is delayed or the relative humidity of the environmental air is lowered to a level where it can hold more moisture by passing the same through a dehumidifier. The evacuation of high humidity air from the sealed bin and replacing it with dry environmental air continues until the first sensor detects that the moisture level per bushel of grain is at a desired level.

An advantage of drying grain according to this invention occurs as dry environmental air eliminates a vacuum throughout an entire sealed bin at substantially the same time to uniformly dry the entire quantity of grain in the sealed bin.

An advantage of the system of drying grain as disclosed in the instant invention occurs since moisture build up in stored grain is eliminated as dry environmental air is communicated to the entire sealed chamber to uniformly eliminate a vacuum created therein through the evacuation of high humidity air from the sealed bin.

Another advantage of grain drying as disclosed in the present invention occurs since the temperature, pressure, and relative humidity of grain in a sealed container is substantially uniform throughout the entire sealed container. An objective of this invention is to provide a grain drying system for a sealed bin with sensing means to detect the moisture content in a bushel of grain and provide a controller with an operational signal for the actuation of a pump to evacuate high relative humidity air from the sealed bin and in the process remove moisture from the grain stored therin. These advantages and objectives should be apparent from reading this specification while viewing the single figure in the drawing

BRIEF DESCRIPTION OF THE INVENTION

The single FIGURE in this drawing illustrates a schematic for a grain conditioning system made according to the principles of the present invention.

DETAILED DESCRIPTION OF THE INVENTION

The grain conditioning system 10 as shown in the drawing is designed to uniformly and substantially simultaneously remove water from each bushel of grain in a sealed bin or silo 12. Grain harvested from a field is directly placed in the silo or sealed bin 12. After the grain is placed in the bin 12, opening 18 in an inflatable and movable seal 20 is closed and after a period of time, the relative humidity of the air in the now sealed bin 12 and correspondingly each bushel of grain therein is detected by a first sensor 14. The first sensor 14 provides controller 16 with an initial signal corresponding to the relative humidity in the sealed bin 12. Controller 16 also constantly receives an environmental signal from sensor 22 that detects the relative humidity of the air in the surrounding environment. If the relative humidity as detected by sensor 22 is above 80%, controller 16 remains in an inactive condition. However should the relative humidity of the environmental air be below 80%, controller 16 responds to the actuation signal from sensor 14 and environmental signal from sensor 22 to supply a first timer 15 with an activation signal. When timer 15 is activated, a signal actuates power relay 26 to simultaneously supply solenoid valve 28 and pump 36 with an actuation signal. Solenoid valve 28 closes and interrupts communication of environmental air through conduit 32 to conduit 34 connected to the sealed bin 12. Conduit 34 also connects the sealed bin 12 with pump 36. With solenoid valve 28 closed, pump 36 begins to evacuate air from the sealed bin 12. As air is evacuated from the sealed bin 12, flexible seal 20 moves toward the grain as the fluid pressure therein is lowered. A pressure sensor 30 detects the fluid pressure in the sealed container or bin 12 and when a predetermined vacuum level is achieved, a termination signal is transmitted to timer 38.

Timer 38 in turn supplies timer 15 with a termination signal to switch power relay 26 to an off position. With relay 26 in the off position, power to pump 36 and solenoid valve 28 is also terminated. Without electrical power, a spring moves a plunger in solenoid valve 28 to open conduit 32 and allow dry environmental air to enter the sealed bin 12. As air enters bin 12, the vacuum is eliminated as the fluid pressure therein approaches atmospheric pressure. When the vacuum is eliminated, the dry environmental air that enters the sealed container or bin 12, picks up moisture from each kernal of grain. Sensor 14 measures the liquid per bushel of grain and continually supplies controller 16 with an update of the relationship between the solid and liquid content per bushel of grain.

An external heat source is not required in this system 10 since heated air creates an undesirable drying front. Should conditions be such that the temperature of the environmental air is below 60 degrees Fahrenheit, in order to increase the moisture carrying capacity of the environmental air, sensor 43 receives an input signal from controller 16 and directs the environmental air through a dehumidifier 42 before it passes through the valve 28. Controller 16 controls the actuation of sensor 43 such that only when environmental air is presented to bin 12 is the dehumidifier actuated. Further, only when environmental air above relative humidity of 80% will the controller supply sensor 43 with an operational signal.

A temperature sensor 40 located in the sealed bin 12 supplies controller 16 with a signal indicative of the temperature of the grain.

As long as sensor 14 detects the moisture content in grain in the sealed bin 12 is above the desired dryness, the controller 16 continues to cycle the solenoid valve 28 and pump 36 to evacuate moisture laden air from the sealed bin 12 and replace the same with dry environmental air. This cycled flow provides for uniform drying throughout the entire sealed bin 12.

In an actual test with a natural drying equilibrium system and the grain conditioning system 10 of the present invention, the following conditions were observed.

In both systems, 7500 bushels of corn was placed in each bin. In the conventional bin, air was continually passed through the grain, while in the conditioning system 10, the bin 12 was sealed. The moisture content in each bushel of grain was detected to be 20%.

A standard bushel of corn being defined as having a weight of 56 pounds and having a moisture content of 15.5% moisture. Since the dry or solids in such a bushel of corn remain constant at 47.32 pounds, the liquid content is fixed at 8.68 pounds.

In a bushel of corn with 20% moisture, the total weight is 59.15 pounds. Since the solids remain constant at 47.32 pounds, the liquid in such a bushel is 11.83. Thus 3.15 pounds of water per bushel must be removed to dry the corn to a safe storage level.

In the test, it was decided to evaluate the difference in the two systems when the corn was dried from 20% moisture to 17% moisture. A bushel of corn with 17% moisture weighs 57.01 pounds and its liquid content is 9.69 pounds. Thus, 2.14 (11.83 -9.69) pounds of water per bushel must be removed to reach 17% moisture in the corn.

The total water needed to be removed from each bin is 2.28 lb./bushel $\times$7500 bushel =17,100 pounds.

In the natural drying system, a 10 HP fan having a rating of 10,000 CFM was used. At the end of 28 days, the moisture in the bin had reached 17%. From this we are able to calculate that 403,200,000 cu. ft. of environmental air had passed through the bin (10,000 CFM $\times$60 minutes $\times$24 Hours $\times$28 days). The cost of operating the 10 HP can be calculated as follows: 28 days $\times$24 hours =672 hours $\times$10 KW =6720 KWH $\times$\$0.05 per KWH (average cost of electricity) =\$336. The cost per bushel is \$336/7500 bushel =\$0.0448 per bushel or \$0.0149 per 1% moisture that is removed.

In the grain conditioning system 10, pump 36 was rated as 15 HP and 220 CFM. At the end of 119 hours of operation of the pump, the moisture in the tin had reached 17%. On the average, the pump 36 had operated for 15 minutes while it took 20 minutes for the dry, environmental air to reach equilibrium with the moisture in the grain within the sealed bin 12 and complete a cycle of operation. The moisture in the system 10 had reached 17% after the completion of 477 cycles of operation. Since the pump 36 only operated for 15 minutes per cycle, the actual pump operational time is 15 minutes $\times$477 cycles =7155 minutes or 119 hours. The pump cost i calculated as follows: 119 hours $\times$15 HP =1788 KWH $\times$\$0.05 cents/KWH =\$89.43 or \$0.012 cents per bushel, which can also be expressed as \$0.004 cents per 1% removal of moisture from the corn.

From the above test, it has been demonstrated that the grain conditioning system 10 is effective, efficient and economical in reducing the moisture content in grain to a level where spoilage does not occur when store in a sealed bin.

I claim:

1. A system for conditioning grain comprising:

a sealed container for storing several bushels of grain, each bushel of said grain having a fixed quantity of solid matter and a variable quantity of liquid;

a first sensor located in said container for sensing the relative humidity in the said container and correspondingly the magnitude of the variable quantity of liquid in each bushel of grain to generate an actuation signal;

a pump connected to said container;

valve means connected to said container for allowing environmental air to be communicated to said container;

control means responsive to said actuation signal for supplying said valve means and pump with operational signals to interrupt communication of environmental air to said container and allow said pump to evacuate air saturated with liquid from said container while creating a predetermined vacuum in said container; and pressure sensing means connected to said container and responsive to said predetermined vacuum for supplying said control means with a vacuum signal to terminate said operational signals and initiate actuation of said valve means to allow environmental air to reenter said container and thereafter be combined with said liquid therein to sequentially reduce said variable quantity of liquid in each bushel of grain, said first sensor continuing to generating said actuation signal until said fixed quantity of solid matter and liquid per bushel reaches an optimum relationship to sustain storage without deterioration.

2. The system for conditioning grain as recited in claim 1 further including:

a second sensor for detecting the relative humidity of the environmental air and supplying said control means with an inhibit signal to delay the development of said operation signals to said valve means and pump when the relative humidity of the environmental air is above a predetermined value.

3. The system for conditioning grain, as recited in claim 2 further including:

dehumidifier means for lowering the relative humidity of said environmental air supplied to said container to increase its liquid absorbing capacity.

4. The system for conditioning grain, as recited in claim 3 further including:

a third sensor located in said container for detecting the temperature in said container and supplying said control means with a temperature signal indicative of the operational conditions in said container.

5. The system for conditioning grain, as recited in claim 4 wherein said Control means evaluates said actuation signal, vacuum signal, inhibit signal and temperature signal to generate said operational signal.

6. The system for conditioning grain, as recited in claim 5 wherein said removal of liquid from each bushel of grain is substantially uniform throughout the entire sealed container.

7. The system for conditioning grain, as recited in claim 6 wherein said first sensor can supply said control means with an input and whereby liquid is added to said sealed container to increase to relative humidity therein when the variable quantity of liquid as detected by said first sensor is below a fixed percentage as compaired to said solid matter per bushel of grain.

* * * * *